US009068344B2

(12) United States Patent
McKenna

(10) Patent No.: US 9,068,344 B2
(45) Date of Patent: Jun. 30, 2015

(54) METHOD FOR INCORPORATING THERMAL BARRIERS INTO TUBULAR EXTRUSIONS USING RETAINER CLIPS

(71) Applicant: Alcoa Inc., Pittsburgh, PA (US)

(72) Inventor: Greg McKenna, Cumming, GA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 14/206,978

(22) Filed: Mar. 12, 2014

(65) Prior Publication Data

US 2014/0260072 A1 Sep. 18, 2014

Related U.S. Application Data

(60) Provisional application No. 61/788,335, filed on Mar. 15, 2013.

(51) Int. Cl.
*E04B 1/00* (2006.01)
*E04B 1/78* (2006.01)

(52) U.S. Cl.
CPC ..... *E04B 1/78* (2013.01)

(58) Field of Classification Search
CPC ..... E04C 3/30; E06B 3/2675; E06B 1/78
USPC ..... 52/741.4, 731, 743, 741, 717.2, 742.1, 52/742.13
See application file for complete search history.

(56) References Cited

U.S. PATENT DOCUMENTS

| | | | | | |
|---|---|---|---|---|---|
| 3,420,026 | A * | 1/1969 | Nolan | 52/204.51 |
| 3,896,589 | A * | 7/1975 | Mitchell | 49/425 |
| 4,057,944 | A * | 11/1977 | Wyatt et al. | 52/309.11 |
| 4,342,144 | A * | 8/1982 | Doguchi | 29/897.312 |
| 4,688,366 | A * | 8/1987 | Schmidt | 52/717.02 |
| 5,391,436 | A * | 2/1995 | Reid | 428/423.1 |
| 5,454,204 | A * | 10/1995 | Jordal | 52/204.591 |
| 6,485,122 | B2 * | 11/2002 | Wolf et al. | 312/406.2 |
| 6,500,550 | B1 * | 12/2002 | Tsuboi et al. | 428/425.8 |
| 6,962,025 | B1 * | 11/2005 | Hill | 52/396.04 |
| 7,096,640 | B1 * | 8/2006 | Chevian et al. | 52/204.591 |
| 2009/0025325 | A1 * | 1/2009 | Gillespie et al. | 52/309.14 |

* cited by examiner

*Primary Examiner* — Basil Katcheves
(74) *Attorney, Agent, or Firm* — Greenberg Traurig, LLP

(57) ABSTRACT

A method to cast-in-place thermal barriers to create a hollow tubular extrusion is disclosed herein. Clips, configured to engage and lock with a first and a second extrusion profile, maintain a pocket with precise tolerances into which liquid polyurethane is poured. The clips easily engage in a manner to form a hollow tubular extrusion assembly. Once the assembly is made, it becomes very difficult to take the assembly apart. This feature allows the first and the second extrusion profiles to be cut to length or handled without the potential of the assembly coming apart prior to pouring the liquid polyurethane. Once the polyurethane cures, there is no need to remove the clips because the clips are made from a very low conductance material, and the clips can remain as part of the finished product thus saving the expense of removing and discarding the part.

20 Claims, 5 Drawing Sheets

METHOD FOR INCORPORATING THERMAL BARRIERS INTO TUBULAR EXTRUSIONS USING RETAINER CLIPS

RELATED APPLICATION

This application claims the benefit of and priority to U.S. Provisional Application No. 61/788,335, filed Mar. 15, 2013, which is incorporated herein by reference in its entirety.

BACKGROUND

Aluminum stands out as a favored choice in windows, doors and other fenestration products because of its structural longevity and its high resistance against corrosion, deflection and wind load. This outstanding material is lightweight and is quick and simple to extrude, machine and fabricate into virtually any form. Optimizing thermal performance contributes to energy efficiency and helps reduce associated heating and cooling costs. The one disadvantage to the use of aluminum in windows and doors is that it is a highly conductive material. Conduction is heat transfer which can be controlled by the addition of low-conductance thermal barrier materials. When a thermal barrier process is completed, there is no aluminum contact from the exterior to interior. Thus, transfer of heat is interrupted, resulting in an energy-efficient, insulating thermal barrier.

Current technology to achieve a thermal barrier uses preformed polyamide struts which are slid into grooves on opposing walls of the tube and then are crimped simultaneously into both halves of the aluminum making a tubular shape. The weakness with this method is that crimping of the polyamide struts cause bowing and distortion of the aluminum halves resulting in a finished part that is not within tolerance. In addition, the shear force developed between the polyamide struts and the aluminum is not sufficient to provide composite bending or adequate torsional strength of the tube. In an attempt to resolve these issues, mandrels are inserted into the tubular shape before crimping. The mandrels provide support for the aluminum and minimize distortion due to the crimping process. The mandrels also allow for a tighter crimp on the polyamide thus increasing the shear force. As an alternative, interior webs are extruded as part of the aluminum section to provide support similar to the mandrels. Both these solutions require the added expense of either using mandrels during the crimping process or adding more metal within the profile to help support the crimping while adding minimal additional shear or torsional strength.

Another option to using polyamide struts as the means to provide a thermal barrier is to use a cast-in-place polyurethane. Typically cast-in-place thermal barriers are poured into a cavity in a single extrusion. Following curing of the polyurethane, the back side of the cavity is then removed creating a structural thermal barrier joining the two halves of the extrusion. For a tubular extrusion, with two cavities on opposing sides of a tubular shape, it is not possible to remove a metal bridge connecting the two halves of the extrusion.

SUMMARY

Creating an effective and efficient method of incorporating a thermal barrier into a tubular aluminum extrusion used to manufacture doors, windows and other fenestration products is desirable. According to aspects illustrated herein, there is disclosed a method for incorporating thermal barriers into tubular aluminum extrusions using retainer clips.

According to aspects illustrated herein, there is provided a method that includes providing a first aluminum extrusion profile for a window or a door, the first aluminum extrusion profile having a first end and a second end, wherein the first end of the first aluminum extrusion profile includes a pocket and a channel, and wherein the second end of the first aluminum extrusion profile includes a pocket and a channel; providing a second aluminum extrusion profile for a window or a door, the second aluminum extrusion profile having a first end and a second end, wherein the first end of the second aluminum extrusion profile includes a pocket and a channel, and wherein the second end of the second aluminum extrusion profile includes a pocket and a channel; providing a first retainer clip that includes a first portion; a second portion; a flat face; and two side walls; providing a second retainer clip that includes a first portion; a second portion; a flat face; and two side walls; installing the first portion of the first retainer clip within the channel of the first end of the first aluminum extrusion profile; installing the first portion of the second retainer clip within the channel of the second end of the first aluminum extrusion profile; installing the second portion of the first retainer clip within the channel of the first end of the second aluminum extrusion profile; installing the second portion of the second retainer clip within the channel of the second end of the second aluminum extrusion profile, wherein, after installation of the first retainer clip and the second retainer clip is completed, a first pour pocket cavity and a second pour pocket cavity are created; pouring liquid polyurethane into the first pour pocket cavity and allowing the liquid polyurethane to cure so as to form a first thermal barrier; and pouring liquid polyurethane into the second pour pocket cavity and allowing the liquid polyurethane to cure so as to form a second thermal barrier, wherein a finished hollow tubular extrusion is formed having two thermal barriers at opposing sides.

According to aspects illustrated herein, there is provided a method that includes providing an aluminum extrusion profile for a window or a door, the aluminum extrusion profile having a first end and a second end, wherein the first end of the aluminum extrusion profile includes a pocket and a channel, and wherein the second end of the aluminum extrusion profile includes a pocket and a channel; providing a plastic extrusion profile for a window or a door, the plastic extrusion profile having a first end and a second end, wherein the first end of the plastic extrusion profile includes a pocket and a channel, and wherein the second end of the plastic extrusion profile includes a pocket and a channel; providing a first retainer clip that includes a first portion; a second portion; a flat face; and two side walls; providing a second retainer clip that includes a first portion; a second portion; a flat face; and two side walls; installing the first portion of the first retainer clip within the channel of the first end of the aluminum extrusion profile; installing the first portion of the second retainer clip within the channel of the second end of the aluminum extrusion profile; installing the second portion of the first retainer clip within the channel of the first end of the plastic extrusion profile; installing the second portion of the second retainer clip within the channel of the second end of the plastic extrusion profile, wherein, after installation of the first retainer clip and the second retainer clip is completed, a first pour pocket cavity and a second pour pocket cavity are created; pouring liquid polyurethane into the first pour pocket cavity and allowing the liquid polyurethane to cure so as to form a first thermal barrier; and pouring liquid polyurethane into the second pour pocket cavity and allowing the liquid polyurethane to cure so as to form a second thermal barrier, wherein a finished hollow tubular extrusion is formed having two thermal barriers at opposing sides.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Figure 1:
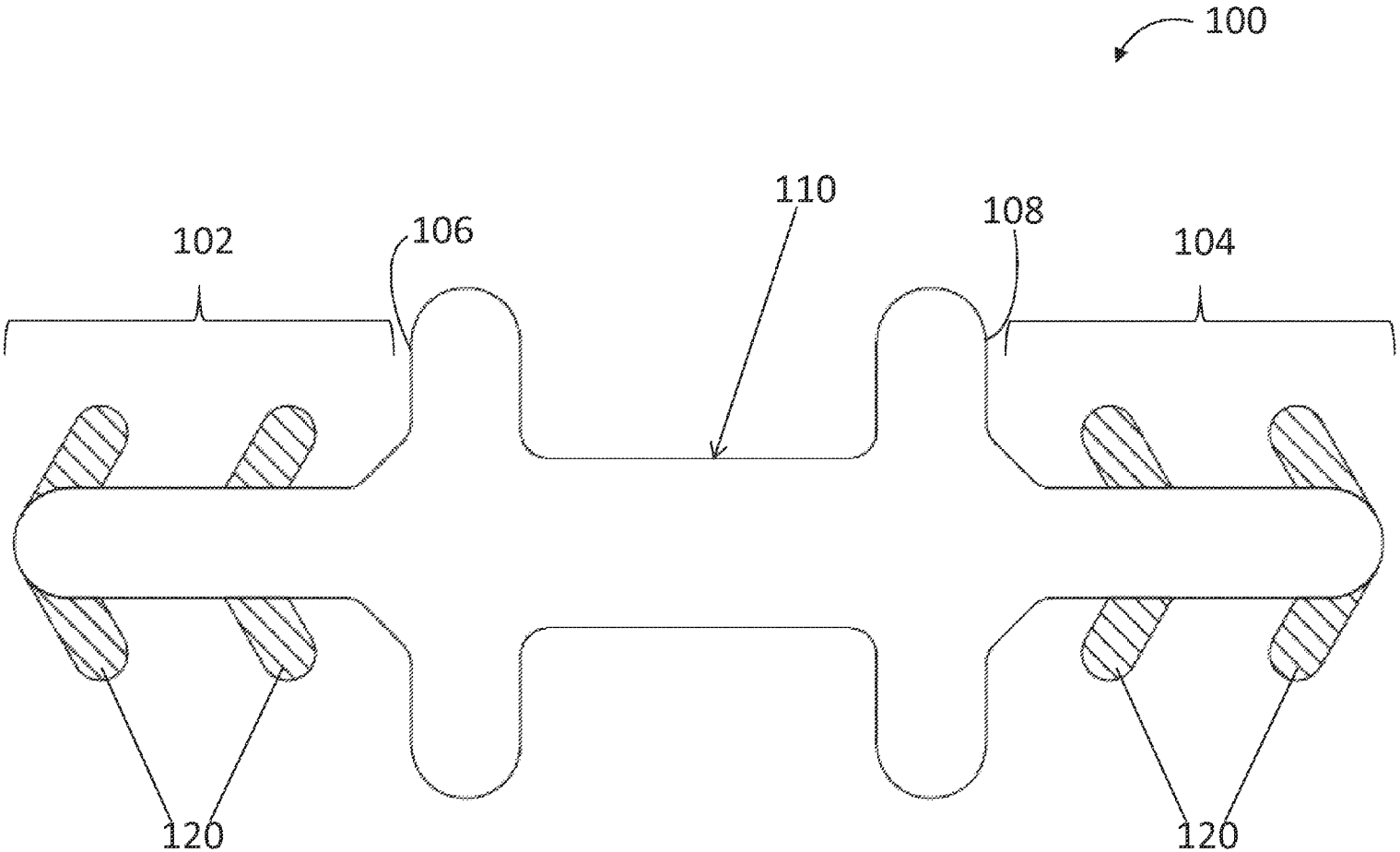
FIG. 1 shows an embodiment of a retainer clip for use in the method of the present invention.
Figure 2E:
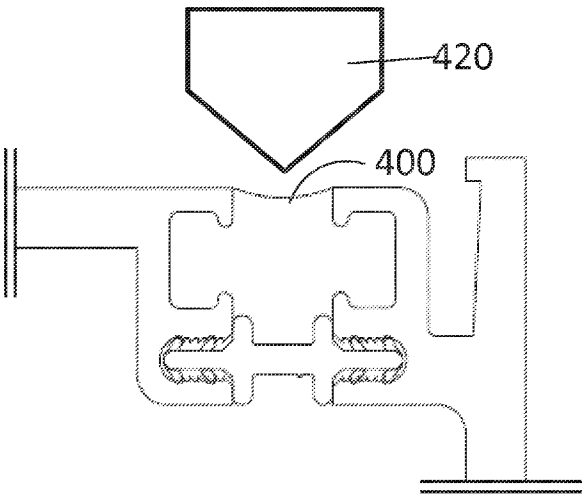
FIGS. 2A-2F show the sequential method steps for creating an enclosed hollow tube aluminum extrusion with cast-in-place thermal barriers on opposing walls.

FIG. 1 shows an embodiment of a retainer clip 100 for use in the method of the present invention. The retainer clip 100 includes a first portion 102, a second portion 104, a flat face 110, and two side walls 106, 108. In an embodiment, the retainer clip 100 is made from a rigid polymer material. The first portion 102 and the second portion 104 each include flexible tips 120. The flexible tips 120 are configured to mate with teeth or serrations on the inside of a channel of an extrusion profile to "lock" the retainer clip 100 with the extrusion profile, as will be described in more detail below. Two flexible tips 120 are illustrated, however those skilled in the art will recognize that the retainer clip 100 can include any number of flexible tips 120 sufficiently designed to perform their function. Once the retainer clip 100 is engaged with the extrusion, the side walls 106 and 108 will butt up against the extrusion to press against the extrusion firmly (see, for example, FIG. 2E). The design enables the retainer clip 100 to easily be pushed into the channel but once the retainer clip 100 is engaged, it takes considerable force to disassemble.

Figure 2F:
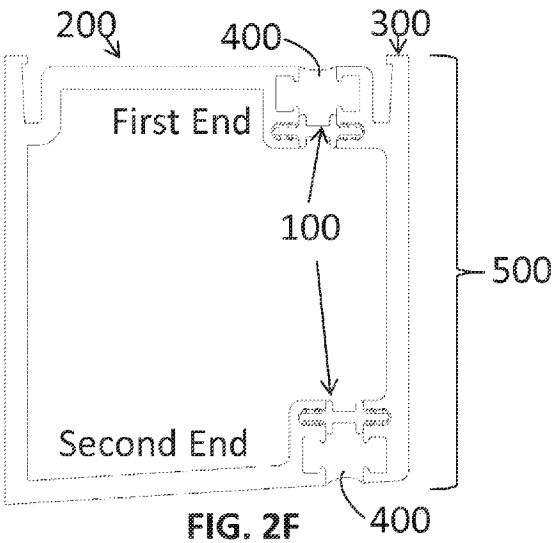
Figure 2A:
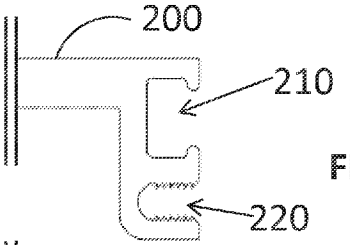
Figure 2B:
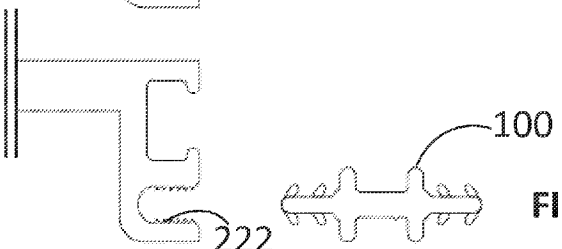
Figure 2C:
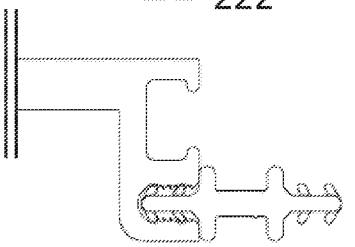

FIGS. 2A-2F show the sequential method steps for creating an enclosed hollow tube extrusion 500 with cast-in-place thermal barriers 400 on opposing walls. FIG. 2A shows a first extrusion profile 200 having a pair of first pockets 210, and a pair of first channels 220 configured to engage and lock with the first portion 102 of retainer clips 100 (only a top portion of the first aluminum extrusion is being illustrated). As illustrated in FIGS. 2B and 2C, the first channels 220 have a plurality of teeth 222 that "catch" the flexible tips 120 of the first portion 102 of the retainer clips 100 to lock the retainer clips 100 with the extrusion profile 200. In an embodiment, the first extrusion profile 200 is an aluminum extrusion profile. In an embodiment, the first extrusion profile 200 is a plastic extrusion profile.

Figure 2D:
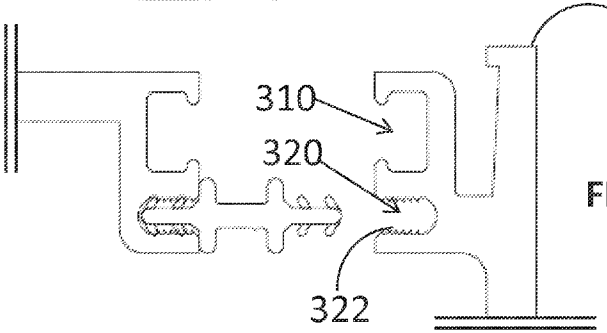

Once the first portion 102 of the retainer clips 100 are locked in position, a second extrusion profile 300 having a pair of second pockets 310, and second channels 320 configured to engage and lock with the second portion 104 of the retainer clips 100 are positioned (only a top portion of the second extrusion is being illustrated), as illustrated in FIG. 2D. The second channels 320 have a plurality of teeth 322 which "catch" the flexible tips 120 of the second portion 104 of the retainer clips 100 to lock the retainer clips 100 with the second extrusion profile 300. Two pour pocket cavities are formed once the first extrusion 200 and the second extrusion 300 are engaged via the retainer clips 100. In an embodiment, the second extrusion profile 300 is an aluminum extrusion profile. In an embodiment, the second extrusion profile 300 is a plastic extrusion profile.

Figure 3:
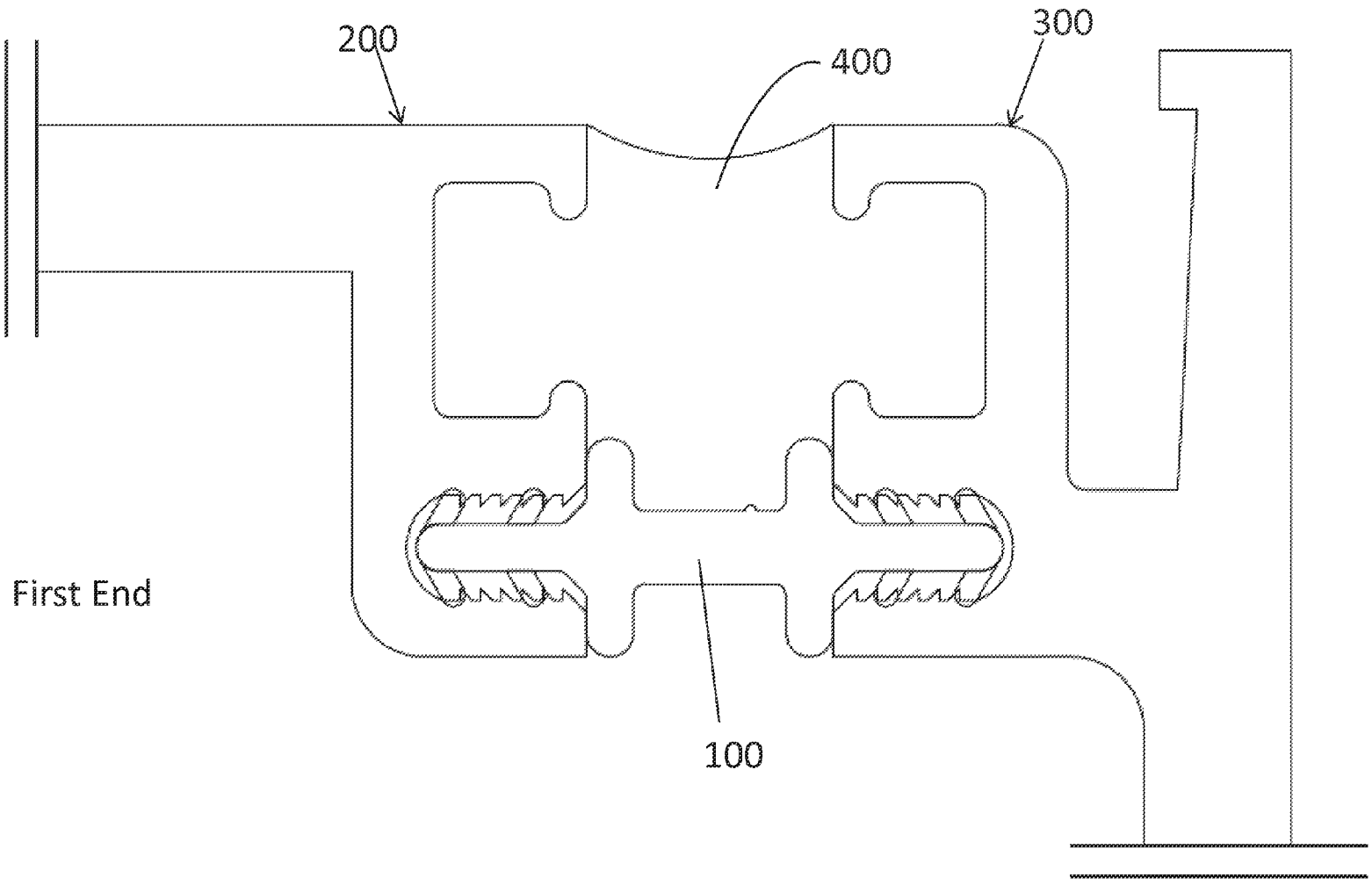
FIG. 3 shows a close-up view of FIG. 2E.

After the retainer clips 100 are locked in position between the first extrusion profile 200 and the second extrusion profile 300, the entire structure is inverted at which point a first thermal barrier 400 is formed within one of the pour pocket cavities formed from the combination of the first pocket 210, the second pocket 310 and the flat face 110 of the first retainer clip 100. This first thermal barrier 400 preferably comprises polyurethane which is poured from a nozzle 420 onto the flat face 110 of the first retainer clip 100 in a liquid state and fills the first pour pocket cavity; see FIG. 2E and FIG. 3. Once the polyurethane is cured, it forms the first thermal barrier 400. The entire structure is then inverted 180° at which point a second thermal barrier 400 is formed within the second pour pocket cavity formed from the combination of the first pocket 210, the second pocket 310 and the flat face 110 of the second retainer clip 100. This thermal barrier 400 preferably comprises polyurethane which is poured from the nozzle 420 onto the flat face 110 of the second retainer clip 100 in a liquid state and fills the second pour pocket cavity. Once the polyurethane is cured, it forms the second thermal barrier 400.

Figure 4:
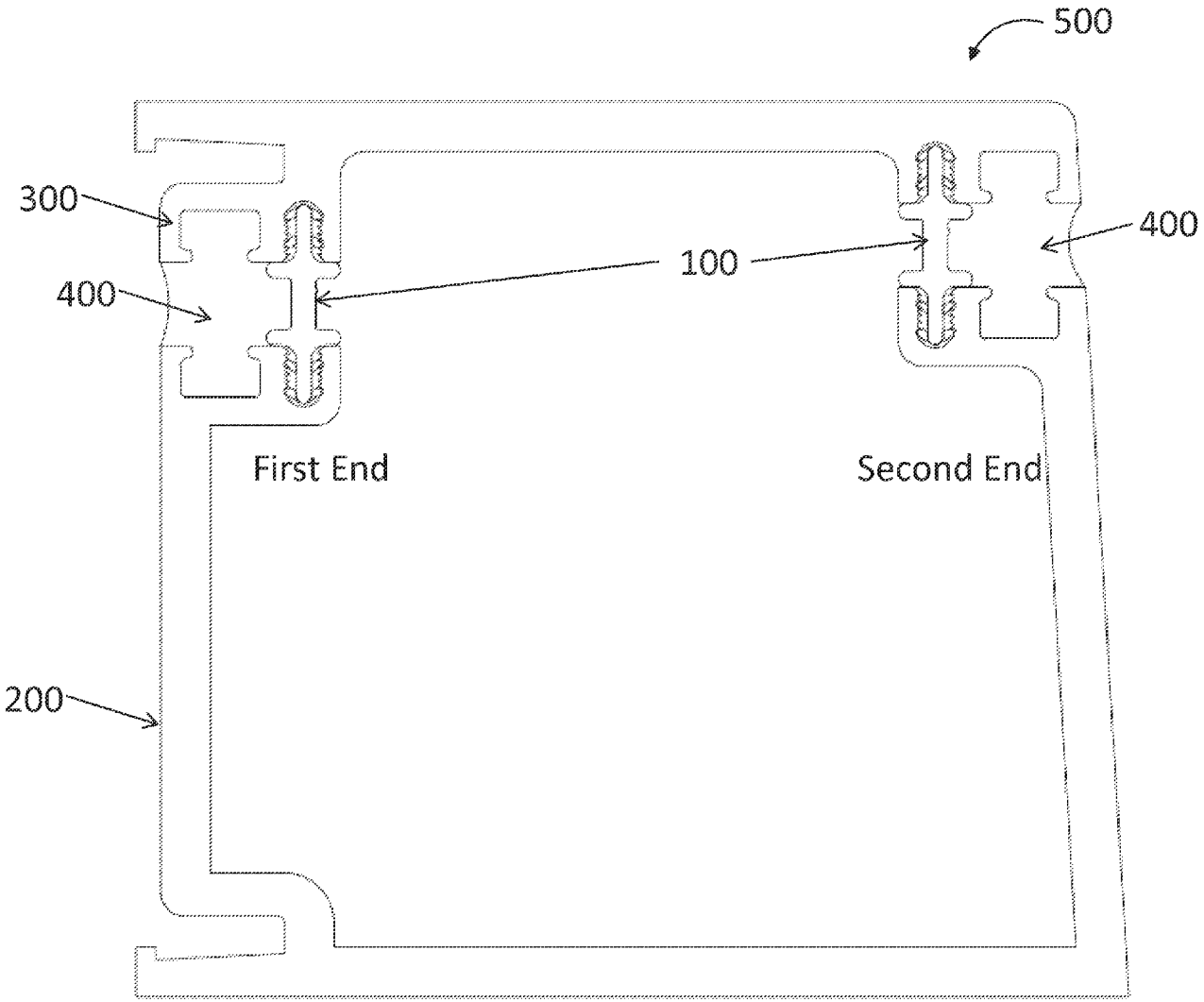
FIG. 4 shows a close-up view of FIG. 2F.

Together the first extrusion profile 200, the second extrusion profile 300, the two retainer clips 100, and the two thermal barriers 400 form a tubular extrusion 500, as illustrated in FIG. 2F and FIG. 4. In FIG. 2F and FIG. 4, both a first end and a second end of the first extrusion profile 200 and the second extrusion profile 300 are visible. In an embodiment, the creation of the thermal barriers 400 provides the ability to create tubular extrusions 500 without the need for supporting webs or mandrels. The resulting tubular extrusion 500 is much stronger, lighter and has a higher thermal value than the existing technology.

Figure 5:
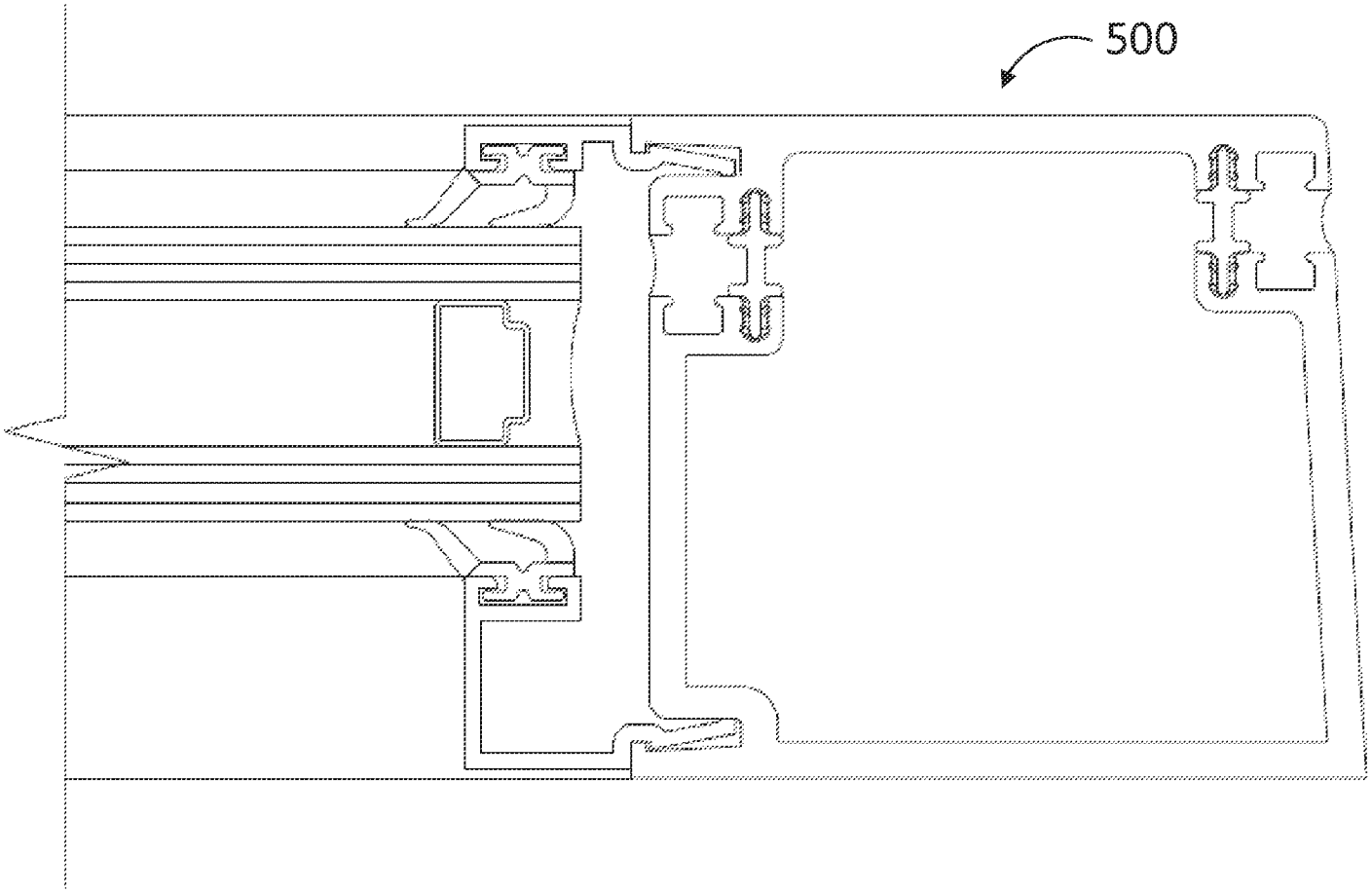
FIG. 5 shows an architectural detail of an entrance door lock style showing the tubular aluminum extrusion of FIG. 4.

FIG. 5 shows an architectural detail of an entrance door lock style showing the enclosed hollow tube extrusion 500 of FIG. 4. The enclosed hollow tube extrusion 500 can be positioned in a number of locations of an entrance door or window including, but not limited to, the header, the bottom rail, the lock style, and the hinge style.

The method of the present invention allows a choice of colors on different faces of a window or door. In an embodiment, the first extrusion profile and the second extrusion profile 300 are each coated with a color. The coating can include anodizing, painting or powder coating. In an embodiment, the first extrusion profile and the second extrusion profile 300 are each coated with the same color. In an embodiment, the first extrusion profile and the second extrusion profile 300 are each coated with a different color.

According to aspects illustrated herein, there is disclosed a method of incorporating a thermal barrier into a tubular aluminum section. A cast-in-place polyurethane is used with this method and a continuous clip that maintains a channel with precise tolerances into which the liquid polyurethane is poured. The clip is designed in such a manner that it can be easily installed into the extrusion profiles but once the assembly is made, it becomes very difficult to take the assembly apart. This feature allows the extrusions to be cut to length or handled without the potential of the assembly coming apart. The continuous clip provides enough strength so that the channel can be conditioned with serrations or lances prior to pouring in the liquid polyurethane to improve the adhesion and composite strength. Once the polyurethane cures, there is no need to remove the continuous clip because it is made from a very low conductance material, and it can remain as part of the finished product thus saving the expense of removing and discarding the part.

A method to cast-in-place thermal barriers on a hollow tubular extrusion is disclosed herein. Clips, configured to engage and lock with a first and a second extrusion profile, maintain a pocket with precise tolerances into which liquid polyurethane is poured. The clips easily engage in a manner to form a hollow tubular extrusion assembly. Once the hollow assembly is made, it becomes very difficult to take the assembly apart. This feature allows the first and the second extrusion profiles to be cut to length or handled without the potential of the assembly coming apart prior to pouring the liquid polyurethane. Once the polyurethane cures, there is no need to remove the clips because the clips are made from a very low conductance material, and the clips can remain as part of the finished product thus saving the expense of removing and discarding the part.

A method includes providing a first aluminum extrusion profile for a window or a door, the first aluminum extrusion profile having a first end and a second end, wherein the first end of the first aluminum extrusion profile includes a pocket and a channel, and wherein the second end of the first aluminum extrusion profile includes a pocket and a channel; providing a second aluminum extrusion profile for a window or a door, the second aluminum extrusion profile having a first end and a second end, wherein the first end of the second aluminum extrusion profile includes a pocket and a channel, and wherein the second end of the second aluminum extrusion profile includes a pocket and a channel; providing a first retainer clip that includes a first portion; a second portion; a flat face; and two side walls; providing a second retainer clip that includes a first portion; a second portion; a flat face; and two side walls; installing the first portion of the first retainer clip within the channel of the first end of the first aluminum extrusion profile; installing the first portion of the second retainer clip within the channel of the second end of the first aluminum extrusion profile; installing the second portion of the first retainer clip within the channel of the first end of the second aluminum extrusion profile; installing the second portion of the second retainer clip within the channel of the second end of the second aluminum extrusion profile, wherein, after installation of the first retainer clip and the second retainer clip is completed, a first pour pocket cavity and a second pour pocket cavity are created; pouring liquid polyurethane into the first pour pocket cavity and allowing the liquid polyurethane to cure so as to form a first thermal barrier; and pouring liquid polyurethane into the second pour pocket cavity and allowing the liquid polyurethane to cure so as to form a second thermal barrier, wherein a finished hollow tubular extrusion is formed having two thermal barriers at opposing sides.

A method includes providing an aluminum extrusion profile for a window or a door, the aluminum extrusion profile having a first end and a second end, wherein the first end of the aluminum extrusion profile includes a pocket and a channel, and wherein the second end of the aluminum extrusion profile includes a pocket and a channel; providing a plastic extrusion profile for a window or a door, the plastic extrusion profile having a first end and a second end, wherein the first end of the plastic extrusion profile includes a pocket and a channel, and wherein the second end of the plastic extrusion profile includes a pocket and a channel; providing a first retainer clip that includes a first portion; a second portion; a flat face; and two side walls; providing a second retainer clip that includes a first portion; a second portion; a flat face; and two side walls; installing the first portion of the first retainer clip within the channel of the first end of the aluminum extrusion profile; installing the first portion of the second retainer clip within the channel of the second end of the aluminum extrusion profile; installing the second portion of the first retainer clip within the channel of the first end of the plastic extrusion profile; installing the second portion of the second retainer clip within the channel of the second end of the plastic extrusion profile, wherein, after installation of the first retainer clip and the second retainer clip is completed, a first pour pocket cavity and a second pour pocket cavity are created; pouring liquid polyurethane into the first pour pocket cavity and allowing the liquid polyurethane to cure so as to form a first thermal barrier; and pouring liquid polyurethane into the second pour pocket cavity and allowing the liquid polyurethane to cure so as to form a second thermal barrier, wherein a finished hollow tubular extrusion is formed having two thermal barriers at opposing sides.

All patents, patent applications, and published references cited herein are hereby incorporated by reference in their entirety. It will be appreciated that several of the above-disclosed and other features and functions, or alternatives thereof, may be desirably combined into many other different systems or application. Various presently unforeseen or unanticipated alternatives, modifications, variations, or improvements therein may be subsequently made by those skilled in the art.

What is claimed is:

1. A method comprising:

providing a first aluminum extrusion profile for a window or a door, the first aluminum extrusion profile having a first end and a second end, wherein the first end of the first aluminum extrusion profile includes a pocket and a channel, and wherein the second end of the first aluminum extrusion profile includes a pocket and a channel;

providing a second aluminum extrusion profile for a window or a door, the second aluminum extrusion profile having a first end and a second end, wherein the first end of the second aluminum extrusion profile includes a pocket and a channel, and wherein the second end of the second aluminum extrusion profile includes a pocket and a channel;

providing a first retainer clip comprising:

a first portion;

a second portion;

a flat face; and two side walls;

providing a second retainer clip comprising:

a first portion;

a second portion;
a flat face; and
two side walls;

laterally pushing the first portion of the first retainer clip within the channel of the first end of the first aluminum extrusion profile;

laterally pushing the first portion of the second retainer clip within the channel of the second end of the first aluminum extrusion profile;

laterally pushing the second portion of the first retainer clip within the channel of the first end of the second aluminum extrusion profile;

laterally pushing the second portion of the second retainer clip within the channel of the second end of the second aluminum extrusion profile, wherein, after installation of the first retainer clip and the second retainer clip is completed, a first pour pocket cavity and a second pour pocket cavity are created;

pouring liquid polyurethane into the first pour pocket cavity and allowing the liquid polyurethane to cure so as to form a first thermal barrier; and pouring liquid polyurethane into the second pour pocket cavity and allowing the liquid polyurethane to cure so as to form a second thermal barrier, wherein a finished hollow tubular extrusion is formed having two thermal barriers at opposing sides.

2. The method of claim 1 wherein the first portion of the first retainer clip includes flexible tips.

3. The method of claim 2 wherein the flexible tips of the first retainer clip engage with a plurality of teeth in the channel at the first end of the first aluminum extrusion profile.

4. The method of claim 1 wherein the first portion of the second retainer clip includes flexible tips.

5. The method of claim 4 wherein the flexible tips of the second retainer clip engage with a plurality of teeth in the channel at the second end of the first aluminum extrusion profile.

6. The method of claim 1 wherein the second portion of the first retainer clip includes flexible tips.

7. The method of claim 6 wherein the flexible tips of the first retainer clip engage with a plurality of teeth in the channel at the first end of the second aluminum extrusion profile.

8. The method of claim 1 wherein the second portion of the second retainer clip includes flexible tips.

9. The method of claim 8 wherein the flexible tips of the second retainer clip engage with a plurality of teeth in the channel at the second end of the second aluminum extrusion profile.

10. The method of claim 1 wherein the first retainer clip and the second retainer clip are made from a rigid polymer material.

11. The method of claim 1 for creating a hollow tubular extrusion for a door assembly.

12. The method of claim 1 for creating a hollow tubular extrusion for a window assembly.

13. The method of claim 1 wherein the first aluminum extrusion profile and the second aluminum extrusion profile each include an integral color coating.

14. The method of claim 13 wherein the color coating of the first aluminum extrusion profile and the color of the second aluminum extrusion profile are the same.

15. The method of claim 13 wherein the color coating of the first aluminum extrusion profile and the color of the second aluminum extrusion profile are different.

16. A method comprising:

providing an aluminum extrusion profile for a window or a door, the aluminum extrusion profile having a first end and a second end, wherein the first end of the aluminum extrusion profile includes a pocket and a channel, and wherein the second end of the aluminum extrusion profile includes a pocket and a channel;

providing a plastic extrusion profile for a window or a door, the plastic extrusion profile having a first end and a second end, wherein the first end of the plastic extrusion profile includes a pocket and a channel, and wherein the second end of the plastic extrusion profile includes a pocket and a channel;

providing a first retainer clip comprising:

a first portion;
a second portion;
a flat face; and
two side walls;

providing a second retainer clip comprising:

a first portion;
a second portion;
a flat face; and
two side walls;

laterally pushing the first portion of the first retainer clip within the channel of the first end of the aluminum extrusion profile;

laterally pushing the first portion of the second retainer clip within the channel of the second end of the aluminum extrusion profile;

laterally pushing the second portion of the first retainer clip within the channel of the first end of the plastic extrusion profile;

laterally pushing the second portion of the second retainer clip within the channel of the second end of the plastic extrusion profile, wherein, after installation of the first retainer clip and the second retainer clip is completed, a first pour pocket cavity and a second pour pocket cavity are created;

pouring liquid polyurethane into the first pour pocket cavity and allowing the liquid polyurethane to cure so as to form a first thermal barrier; and pouring liquid polyurethane into the second pour pocket cavity and allowing the liquid polyurethane to cure so as to form a second thermal barrier, wherein a finished hollow tubular extrusion is formed having two thermal barriers at opposing sides.

17. The method of claim 16 for creating a hollow tubular extrusion for a door assembly.

18. The method of claim 16 for creating a hollow tubular extrusion for a window assembly.

19. The method of claim 16 wherein the aluminum extrusion profile and the plastic extrusion profile each include an integral color coating.

20. The method of claim 16 wherein the first portion and the second portion of both the first retainer clip and the second retainer clip each include flexible tips.

* * * * *